US005747725A

United States Patent [19]

Stewart et al.

[11] Patent Number: 5,747,725

[45] Date of Patent: May 5, 1998

[54] PRE-MOLDED AFT SEAL FOR DISCARDING SABOT PROJECTILES

[75] Inventors: W. Brian Stewart, Lancaster; Donald R. Osment, East Petersburg; John W. Duchek, Red Lion, all of Pa.

[73] Assignee: Primex Technologies, Inc., Red Lion, Pa.

[21] Appl. No.: 649,392

[22] Filed: May 17, 1996

[51] Int. Cl.[6] ..... F42B 14/06

[52] U.S. Cl. ..... 102/521; 102/532

[58] Field of Search ..... 102/439, 520–523, 102/532

[56] References Cited

U.S. PATENT DOCUMENTS

| | | | |
|---|---|---|---|
| 4,524,695 | 6/1985 | Bisping et al. . | |
| 4,542,696 | 9/1985 | Bisping et al. . | |
| 4,917,017 | 4/1990 | Beltz . | |
| 4,936,220 | 6/1990 | Burns et al. . | |
| 4,967,668 | 11/1990 | Warren . | |
| 5,063,855 | 11/1991 | Diel et al. . | |
| 5,183,961 | 2/1993 | Campoli et al. . | |
| 5,227,580 | 7/1993 | Berville et al. | 102/521 |
| 5,473,989 | 12/1995 | Buc | 102/521 |

FOREIGN PATENT DOCUMENTS

| | | | |
|---|---|---|---|
| 0 152 492 A1 | 8/1985 | European Pat. Off. . | |
| 39 04 626 A1 | 8/1990 | Germany . | |
| WO 91/12484 | 8/1991 | WIPO | 102/522 |

*Primary Examiner*—Harold J. Tudor

*Attorney, Agent, or Firm*—Todd E. Garabedian; Wiggin & Dana

[57] ABSTRACT

An armor piercing fin stabilized discarding sabot kinetic energy projectile includes a pre-molded plastic aft seal sleeve to protect the sabot from damage from the propellant and replaces both the RTV and the protective sheath of conventional designs. The seal is manufactured from thermoplastic polyurethane or thermoplastic polyester elastomer.

10 Claims, 2 Drawing Sheets

PRE-MOLDED AFT SEAL FOR DISCARDING SABOT PROJECTILES

BACKGROUND OF THE INVENTION

1. Field of the Invention

This invention generally relates to Armor Penetrating, Fin Stabilized Discarding Sabot (APFSDS) Kinetic Energy (KE) projectile cartridges and more particularly to pre-molded seal sleeves designed to prevent gas intrusion into a projectile assembly.

2. Description of Related Art

Current configurations for 105 mm and 120 mm APFSDS KE tank ammunition cartridges typically include a projectile assembly centrally located within a case.

The ammunition cartridge basically includes a tubular case having a closed head end and an open mouth end. The projectile assembly extends into and is secured to the case mouth end. During assembly of the cartridge, a propellant is loaded into the cavity between the case and the projectile assembly.

The projectile assembly includes a long rod shaped penetrator which has a pointed front tip and a fin assembly attached to the rear of the penetrator. The penetrator is encircled by a sabot assembly which has three sabot segments spaced from each other 120°. Each sabot segment has a front bourrelet portion, a rearwardly tapered central portion, an aft bourrelet, and a tapered rear portion. Each sabot segment has two flat radial faces which extend axially from front to rear. The segments are joined with faces abutting one another around the penetrator to form the full bore sabot.

The propellant for firing the projectile creates copious amounts of heat and gas during combustion. Without protection, the projectile assembly may be damaged by the heat and gas. Accordingly, an aft seal is provided to prevent gas and heat intrusion into the projectile assembly. Aft seal sleeves are conventionally formed of silicone rubber or room temperature vulcanized rubber (RTV) and formed by in-place molding over the tapered rear portion of the sabot after the projectile is placed in the casing.

A conventional APFSDS KE weapon using a rubber or an RTV seal is disclosed in U.S. Pat. No. 5,183,961 to Campoli et al. which is herein incorporated by reference in its entirety. The Campoli et al. patent discloses a rubber or an RTV seal manufactured by in-place injection molding of RTV into a mold cap which is placed on the projectile aft ramp. The required mold tooling and process operations generally make this manufacturing technique time-consuming and expensive.

During ballistic test firings of saboted projectiles, the propellant typically tears or gouges the RTV seals provided to protect the projectile during the propellant burn process. A damaged RTV seal allows gases to penetrate the projectile assembly and either damage the projectile or reduce its ballistic performance.

Additionally, RTV does not bond especially well to the sabot material. A properly prepared surface of an aluminum sabot may provide a good bonding surface for the RTV, but requires additional processing steps that add cost. Moreover, new configurations of large caliber ammunition include sabots of high strength composite materials. Typically, these composite materials provide poor bonding capability for RTV that may lead to poor performance because of projectile damage.

Accordingly, a seal is needed which eliminates problems associated with the RTV seal. There is also needed a seal that can be easily tailored to specific requirements by modifying component blend ratios.

There is also needed a seal that can then be bonded to a sabot using an adhesive which is selected based on its capability to bond to both the sabot and the seal.

There is also needed a seal that can be manufactured and installed at reduced costs when compared to the current RTV process of molding the seal in-place.

Finally, there is also needed a seal to reduce the overall projectile weight when compared to the current RTV shield configuration.

SUMMARY OF THE INVENTION

Accordingly, the present invention is directed to an aft sabot seal that substantially obviates one or more of the problems due to limitations and disadvantages of the related art.

In accordance with the purpose of the invention, as embodied and broadly described, the invention provides an aft seal for an armor piercing fin stabilized discarding sabot (APFSDS) projectile that is a semi-rigid plastic sleeve effective to seal an APFSDS projectile from combustion products. Furthermore, the invention provides an aft seal sleeve having a hardness of 95A to 72D at room temperature. Additionally, the invention provides an aft seal sleeve wherein the sleeve is made from a plastic is selected from the groups consisting essentially of thermoplastic polyurethane and thermoplastic polyester elastomer.

In another embodiment, the invention provides a method of providing an armor piercing fin stabilized discarding sabot projectile having an aft seal including selecting a material from the groups consisting essentially of thermoplastic polyurethane and polyester thermoplastic elastomer and providing a mold for the aft seal. The material is injected into the mold and the formed aft seal is removed from the mold and then placed on the armor piercing fin stabilized discarding sabot projectile.

In still another embodiment, the invention provides an armor piercing fin stabilized discarding sabot projectile including a tubular case having a closed head end and an open mouth end and a projectile assembly extending into and secured to the open mouth end. A combustion source surrounds a rear portion of the projectile assembly extending into the open mouth end and a semi-rigid plastic seal is disposed around a portion of the projectile assembly extending into the open mouth end effective to seal the projectile from combustion products.

The accompanying drawings are included to provide a further understanding of the invention and are incorporated in and constitute a part of the specification illustrating an embodiment of the invention and together with the description serve to explain the principles of the invention.

IN THE DRAWINGS

DETAILED DESCRIPTION

Figure 1:
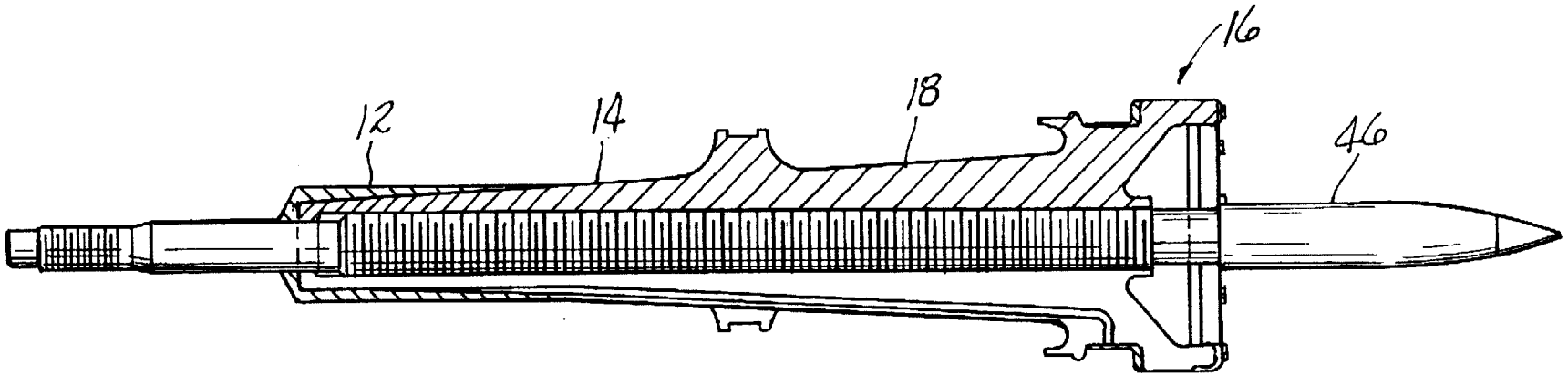
FIG-1 PRIOR ART
FIG. 1 is a saboted projectile assembly and case extension known in the prior art.

A saboted projectile assembly is illustrated in FIG. 1 and referenced by the numeral 10. Conventionally, an aft seal sleeve 12 is rubber or RTV and is formed by molding in place over a tapered rear portion 14 of a sabot 16 after sabot segments 18 are joined. Additionally, a protective sheath may be formed or placed over the RTV to provide additional protection from heat/gas damage from the propellant.

Figure 2:
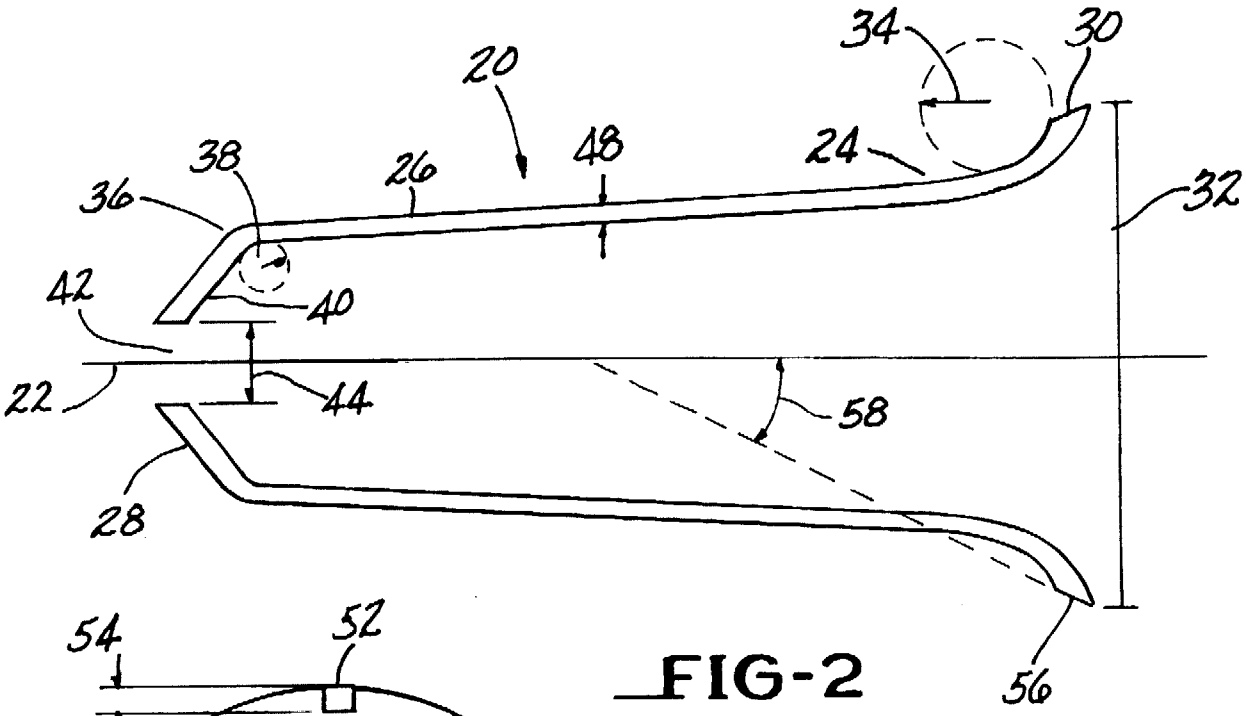
FIG. 2 is a longitudinal section of an aft seal according to the present invention.

According to the present invention, the aft seal sleeve 12, as well as any protective sheath which might be used to cover the aft seal sleeve 12, is replaced by a pre-molded aft seal sleeve 20, illustrated in FIG. 2. The pre-molded aft seal sleeve 20 is a unitary hollow cylindrical form about an axial centerline 22.

The pre-molded aft seal sleeve 20 is formed in a separate molding operation and then bonded to the sabot 16.

Preferably, the aft seal sleeve 20 is thermoplastic polyurethane or thermoplastic polyester elastomer (TPU or TPE). Additionally, the aft seal sleeve 20 could be made from any number of various TPE or TPU materials. The aft seal sleeve 20 is made from a material having shore A hardness of 95 at ambient conditions (20° C.), up to Shore D hardness of 72 at 20° C.

TPU and TPE materials are much tougher and more tear resistant than RTV. Furthermore, these materials are easily molded and prevent tearing and scoring damage of the KE projectile during gun launch conditions. In addition, the material properties of TPU and TPE can be easily tailored to desired requirements by modifying the blend ratios of the two plastic and elastomeric components.

Further, according to the present preferred embodiment, the aft seal sleeve 20 is pre-molded in a separate manufacturing process rather than being molded in place as in conventional aft seal sleeves. The pre-molded aft seal sleeve 20 can then be bonded to the sabot 16 using an adhesive which is selected based on its capability to bond to both the sabot 16 and the pre-molded aft seal sleeve 20. This is especially important when the sabot 16 is made from composite materials instead of aluminum, for example, because RTV does not bond well with typical high strength composite materials, such as carbon/epoxy. This assures that the pre-molded aft seal sleeve 20 will not be disturbed during the gun launch conditions. One preferred adhesive used for the present embodiment is a two-part polyurethane adhesive for bonding the aft seal sleeve 20 to the sabot 16, wherein the sabot 16 is a carbon fiber composite structure.

The pre-molded aft seal sleeve 20 may assume multiple alternative embodiments depending on the shape of the sabot 16. Generally, a seal according to the preferred embodiment is effective if the manufactured tolerances are within 0.02 inches of the actual sabot surface contour to be covered.

In one preferred embodiment, and although formed as a single unitary piece, the pre-molded aft seal sleeve 20, may be described as having an outwardly flanged first portion 24, a constantly decreasing diameter second portion 26, and an inwardly flanged third portion 28. The first portion 24 integrally connects a flange edge 30 with the second portion 26. The second portion 26 integrally connects the first portion 24 with the third portion 28.

The flange edge 30 is circular about the axial centerline 22 and has a diameter 32 from about 3.7 to about 4.1 inches. Preferably, diameter 32 is from about 3.8 to about 4.0 inches, more preferably, diameter 32 is from about 3.95 to about 3.98 inches.

In the alternative, the flange edge 30 preferably has diameter 32 approximately equal to the conventional aft seal sleeves 12.

The first portion 24 outwardly flanges with a radius of curvature 34 from about 1 inch to 2 inches. Preferably, the radius of curvature 34 is from about 1.1 to 1.4 inches, more preferably, the radius of curvature 34 is from about 1.20 to 1.25 inches. Alternately, the first portion 24 outwardly flanges with a radius of curvature approximately equal to the conventional aft seal sleeves 12.

The second portion 26 has a constantly decreasing diameter having no radius of curvature from the first portion 24 to the third portion 28.

The third portion 28 is an inwardly flanged cylinder integrally connected to the second portion 26 at a location 36. The location 36 connects the second portion 26 and the third portion 28 and has a radius of curvature 38 from about 0.01 inch to about 0.09 inch. Preferably, the radius of curvature 38 is from about 0.02 inch to about 0.08 inch, more preferably, the radius of curvature 38 is from about 0.045 inch to about 0.065 inch. The third portion 28 has a flange angle 40 with the second portion 26 measured inside the pre-molded aft seal sleeve 20 from about 148° to about 160°. Preferably the flange angle 40 is from about 150° to about 158°, more preferably, the flange angle 40 is from about 152° to about 154°. Alternatively, the radius of curvature 38 and the flange angle 40 are approximately equal to the conventional aft seal sleeves 12.

Axially located in within the third portion 28 is a circular center bore 42 having a diameter 44 from about 0.8 inch to about 0.9 inch adapted to receive a penetrator 46 (illustrated in FIG. 1). The diameter 44 is preferably from about 0.82 inch to about 0.88 inch, more preferably, the diameter 44 is from about 0.83 inch to about 0.85 inch. Alternatively, the diameter 44 is approximately equal to conventional aft seal sleeves 12.

The first portion 24 and the second portion 26 have a thickness 48 from about 0.02 inch to about 0.08 inch. Preferably, the thickness 48 is from about 0.03 inch to about 0.07 inch, more preferably the thickness 48 is from about 0.04 inch to about 0.05 inch. The third portion 28 has thickness 50 from about 0.06 inch to about 1.00 inch. Preferably, the third portion 28 has thickness 50 from about 0.07 inch to about 0.089 inch, more preferably, the thickness 50 is from about 0.08 inch to about 0.09 inch. Alternatively, the first, second, and third portions 24, 26, and 28 have thicknesses 48 and 50 approximately equal to convention aft seal sleeves 12.

Figure 3:
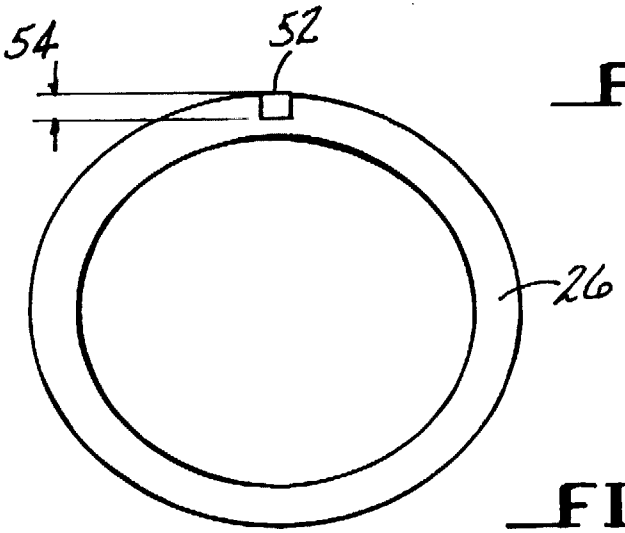
FIG. 3 is a partial cross-section of the aft seal of FIG. 2.

The aft seal sleeve 20 includes three grooves 52 having a U-shaped cross section running axially along the aft seal sleeve 20 from the flange edge 30 to center bore 42 (a cross section of a groove 52 is illustrated in FIG. 3). The grooves 52 are circumferentially spaced equally from each other so that the grooves 52 are about 120° from each other as measured from the axial centerline 22 of the pre-molded aft seal sleeve 20 outward. The grooves 52 have a depth 54 no less than about 0.02 inch. Preferably the depth 54 is no less than about 0.018 inch, more preferably, the depth 54 is no less than about 0.016 inch. The grooves 52 allow for controlled tearing of the aft seal sleeve 20 upon projectile exit from the gun tube and subsequent sabot discard from the penetrator 46.

The first portion 24 has an edge 56 at the flange edge 30. The edge 56 meets the flange edge 30 with an angle 58 as measured from the axial centerline 22 of the pre-molded aft seal sleeve 20. The angle 58 is from about 25° to about 35°. Preferably, the angle 58 is from about 27° to about 33°, more preferable, the angle 58 is from about 30° to about 31°. Alternatively, the angle 58 is approximately equal to the conventional aft seal sleeves 12.

The pre-molded aft seal sleeve 20 may be slide fit or adhesively bonded to the rear portion 14.

EXAMPLE 1

Example 1 formed a pre-molded aft seal sleeve 20 from Santoprene 101-73, a highly rubberized polyolefin TPE material having an elastic modulus of 520 psi at room temperature (20° C.), that may be made, for example, may by Monsanto Corporation.

The pre-molded aft seal sleeve 20 made from Santoprene 101-73 shrunk after being removed from its mold. The shrinkage makes Santoprene 101-73 less preferred as a material for pre-molded aft seal sleeve 20.

EXAMPLE 2

Example 2 formed a pre-molded aft seal sleeve 20 from Elastollan 1195A, a relatively stiff polyurethane rubbery material having an elastic modulus of 1750 psi at room temperature (20° C.) and is manufactured by, for example, BASF Corporation.

The pre-molded aft seal sleeve 20 made from this material was tested via projectile ballistic testing. The material was determined to be more than adequate at cold temperatures (−25° F.) but was too soft at hot conditions (130° F.).

EXAMPLE 3

Example 3 formed a pre-molded aft seal sleeve 20 from Riteflex 672, a harder more "plastic" thermoplastic elastomer polyester elastomeric material having an elastic modulus of 92,000 psi at room temperature (20° C.) and is manufactured, for example, by Moechst Celanese Corporation.

The pre-molded aft seal sleeve 20 made from this material was tested via projectile ballistic testing. The material was determined to be adequate at temperatures of about 130° F., but at cold temperature of about −25° F., the material was too stiff and shattered due to the load conditions imposed by the gun launch environment.

The pre-molded aft seal sleeve 20 described above can be manufactured and installed at a much reduced cost when compared to current RTV processes.

Furthermore, the overall projectile weight is reduced (leading to higher performance) when compared to the current RTV and protective aft shield configuration.

While the invention has been described in combination with embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A pre-molded aft seal for an armor piercing fin stabilized discarding sabot (APFSDS) projectile comprising:

a plastic sleeve made from a material selected from the group consisting of thermoplastic polyurethane and thermoplastic polyester elastomer and effective to seal said APFSDS projectile from combustion products, said plastic aft sleeve further comprises:

an outwardly flanged first portion having a radius of curvature of from about 1 inch to 2 inches;

a constantly decreasing diameter second portion; and an inwardly flanged substantially conical third portion connected to said second portion by a curved portion having a radius of curvature of from about 0.01 inch to 0.09 inch.

2. The pre-molded aft seal according to claim 1, wherein the plastic sleeve has a hardness of between 95A and 72D at room temperature.

3. The aft seal of claim 1, wherein said third portion has a flange angle relative to said second portion of from about 148° to 160° as measured from the inside of said sleeve.

4. The aft seal of claim 1, wherein said outwardly flanged first portion has a diameter of from about 3.8 to about 4.0 inches.

5. The aft seal of claim 1, wherein said inwardly flanged third portion has a central bore having a diameter of from about 0.8 to about 0.9 inches.

6. An armor piercing fin stabilized discarding sabot projectile, comprising:

a projectile assembly comprising a penetrator surrounded by a sabot;

a pre-molded plastic aft seal disposed around a portion of the sabot and made from a material selected from the group consisting of thermoplastic polyurethane and thermoplastic polyester elastomer and effective to seal the projectile assembly from combustion products said plastic aft seal further comprises:

an outwardly flanged first portion having a radius of curvature of from about 1 inch to 2 inches;

a constantly decreasing diameter second portion; and an inwardly flanged substantially conical third portion connected to said second portion by a curved portion having a radius of curvature of from about 0.01 inch to 0.09 inch.

7. The aft seal according to claim 6, wherein the plastic sleeve has a hardness of between 95A and 72D at room temperature.

8. The armor piercing fin stabilized discarding sabot projectile of claim 6, wherein said third portion has a flange angle relative to said second portion of from about 148° to 160° as measured from the inside of said sleeve.

9. The armor piercing fin stabilized discarding sabot projectile of claim 6, wherein said outwardly flanged first portion has a diameter of from about 3.8 to about 4.0 inches.

10. The armor piercing fin stabilized discarding sabot projectile of claim 6, wherein said inwardly flanged third portion has a central bore having a a diameter of from about 0.8 to about 0.9 inches.

* * * * *